US006952933B2

(12) United States Patent
Song et al.

(10) Patent No.: US 6,952,933 B2
(45) Date of Patent: Oct. 11, 2005

(54) MULTI-TYPE AIR CONDITIONER

(75) Inventors: Jin Seob Song, Gunpo-si (KR); Se Dong Chang, Gwangmyeon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/713,250

(22) Filed: Nov. 17, 2003

(65) Prior Publication Data

US 2004/0134214 A1 Jul. 15, 2004

(30) Foreign Application Priority Data

Jan. 13, 2003 (KR) ..... 10-2003-0002037

(51) Int. Cl.[7] ..... F25B 5/02
(52) U.S. Cl. ..... 62/200; 62/324.6
(58) Field of Search ..... 62/199, 200, 324.1, 62/324.6

(56) References Cited

U.S. PATENT DOCUMENTS

| | | | | |
|---|---|---|---|---|
| 3,779,031 A | * | 12/1973 | Akiyama et al. | 62/160 |
| 4,474,026 A | * | 10/1984 | Mochizuki et al. | 62/157 |
| 4,483,151 A | * | 11/1984 | Fujioka et al. | 62/157 |
| 4,537,041 A | * | 8/1985 | Denpou et al. | 62/199 |
| 4,643,002 A | | 2/1987 | Dennis et al. | |
| 4,766,735 A | * | 8/1988 | Gotou | 62/175 |
| 4,771,610 A | * | 9/1988 | Nakashima et al. | 62/160 |
| 4,779,425 A | * | 10/1988 | Yoshihisa et al. | 62/199 |
| 4,862,705 A | * | 9/1989 | Nakamura et al. | 62/324.1 |
| 5,040,376 A | | 8/1991 | Ueno | |
| 5,709,097 A | * | 1/1998 | Kim et al. | 62/206 |
| 2004/0018083 A1 | | 1/2004 | Sohn et al. | |

FOREIGN PATENT DOCUMENTS

| | | |
|---|---|---|
| CN | 2 357243 Y | 1/2000 |
| EP | 0959308 | 11/1999 |
| JP | 2-93263 | 4/1990 |
| JP | 07-043042 | 2/1995 |
| JP | 11-94395 | 4/1999 |
| KR | 92-008504 | 9/1992 |

OTHER PUBLICATIONS

English Language Abstract of JP 2–93263.
English Language Abstract of Jp07–043042.

* cited by examiner

*Primary Examiner*—William E. Tapolcai
(74) *Attorney, Agent, or Firm*—Greenblum & Bernstein, P.L.C.

(57) ABSTRACT

Multi-type air conditioner including an outdoor unit having a compressor, an outdoor heat exchanger, a flow path control valve for controlling a flow path of the refrigerant from the compressor, and an outdoor unit piping system, a plurality of indoor units each having an indoor expansion device, an indoor heat exchanger, and an indoor piping system, a distributor for selectively distributing the refrigerant from the outdoor unit to the indoor units and returning to the outdoor unit again proper to respective operation modes, and noise preventing means on pipelines respectively connected to the indoor units to cut off refrigerant flow into inoperative indoor units when the air conditioner is in operation, for preventing occurrence of refrigerant flow noise at the inoperative indoor units.

24 Claims, 6 Drawing Sheets valve open
valve closed
expansion operating
open
close

MULTI-TYPE AIR CONDITIONER

This application claims the benefit of the Korean Application No. P2003-0002037 filed on Jan. 13, 2003, which is hereby incorporated by reference.

BACKGROUND OF THE INVENTION

1. Field of the Invention

The present invention relates to multi-type air conditioners, and more particularly, to a multi-type air conditioner which can cool or heat a plurality of rooms, individually.

2. Background of the Related Art

In general, the air conditioner is an appliance for cooling or heating spaces, such as living spaces, restaurants, and offices. At present, for effective cooling or heating of a space partitioned into many rooms, it is a trend that there has been ceaseless development of multi-type air conditioner. The multi-type air conditioner is in general provided with one outdoor unit and a plurality of indoor units each connected to the outdoor unit and installed in a room, for cooling or heating the room while operating in one of cooling or heating mode.

However, since the multi-type air conditioner is operative only in one mode of cooling or heating uniformly even if some of the many rooms within the partitioned space require heating, and rest of the rooms require cooling, the multi-type air conditioner has a limit in that the requirement can not be met, properly.

For an example, even in one building, there are rooms having a temperature difference depending on locations of the rooms or time of the day, such that while a north side room of the building requires heating, a south side room of the building requires cooling due to the sun light, which can not be dealt with a related art multi-type air conditioner that is operative in a single mode.

Moreover, even though a building equipped with a computer room requires cooling not only in summer, but also in winter for solving the problem of heat load of the computer related equipment, the related art multi-type air conditioner can not deal with such a requirement, properly.

In conclusion, the requirement demands development of multi-type air conditioner of concurrent cooling/heating type, for making air conditioning of rooms individually, i.e., the indoor unit installed in a room requiring heating is operable in a heating mode, and, at the same time, the indoor unit installed in a room requiring cooling is operable in a cooling mode.

SUMMARY OF THE INVENTION

Accordingly, the present invention is directed to a multi-type air conditioner that substantially obviates one or more of the problems due to limitations and disadvantages of the related art.

An object of the present invention is to provide a multi-type air conditioner, which can heat or cool rooms individually, and prevent refrigerant flow noise coming from an indoor unit that is not in operation.

Another object of the present invention is to provide a multi-type air conditioner which can prevent refrigerant from staying in an indoor unit not in operation and refrigerant pipeline.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the multi-type air conditioner includes an outdoor unit having a compressor, an outdoor heat exchanger, a flow path control valve for controlling a flow path of the refrigerant from the compressor, and an outdoor unit piping system, a plurality of indoor units each having an indoor expansion device, an indoor heat exchanger, and an indoor piping system, a distributor for selectively distributing the refrigerant from the outdoor unit to the indoor units and returning to the outdoor unit again proper to respective operation modes, and noise preventing means on pipelines respectively connected to the indoor units to cut off refrigerant flow into inoperative indoor units when the air conditioner is in operation, for preventing occurrence of refrigerant flow noise at the inoperative indoor units.

The noise preventing means may include a first valve on a pipeline connected to the indoor heat exchanger for cutting off supply of the refrigerant to the inoperative indoor unit. The noise preventing means may include a second valve on a pipeline connected to the indoor expansion device for cutting off supply of the refrigerant to the inoperative indoor unit. The noise preventing means may include the indoor expansion device having a system which can be closed to cut off refrigerant supply to the inoperative indoor unit. The noise preventing means may include both the first valve and the second valve, or both the first valve and the indoor unit expansion device.

The multi-type air conditioner may further include bypass means for the refrigerant staying in the pipeline connected to the indoor expansion device to bypass the inoperative indoor unit. In this instance, the bypass means includes a bypass pipe connecting two pipelines connected to make the refrigerant to flow in/out of each of the indoor units, and a bypass valve on the bypass pipe for opening/closing the bypass pipe. The bypass valve has a sectional flow passage area smaller than the flow sectional area of the bypass pipe, for bypassing minimum refrigerant.

In the meantime, the flow path control valve includes a first port in communication with an outlet of the compressor, a second port in communication with the outdoor heat exchanger, a third port in communication with an inlet of the compressor, and a fourth port blanked, or connected to a closed pipe piece.

The outdoor piping system includes a first pipeline connected between the outlet of the compressor and the first port, a second pipeline connected between the second port and the first port of the outdoor unit having the outdoor heat exchanger mounted in the middle thereof, a third pipeline connected between the first pipeline and the second pipeline of the outdoor unit, and a fourth pipeline connected between the third port and the inlet of the compressor having a middle part connected to the third port of the outdoor unit.

The outdoor unit further includes an accumulator on the fourth pipeline between the third port of the outdoor unit and the inlet of the compressor. The outdoor unit further includes a check valve on the second pipeline between the outdoor heat exchanger and the first port of the outdoor unit, and an outdoor expansion device mounted on the second pipeline in parallel to the check valve. The check valve only permits refrigerant flow from an outdoor heat exchanger side to a first port side.

The first port of the outdoor unit is connected to the first port of the distributor, the second port of the outdoor unit is connected to the second port of the distributor, and the third port of the outdoor unit is connected to the third port of the distributor.

The distributor includes a distributor piping system for guiding refrigerant from the outdoor unit to the indoor units, and from the indoor units to the outdoor unit, and a valve bank on the distributor piping system for controlling the refrigerant flowing in the distributor piping system proper to respective operation modes.

The distributor piping system includes a liquid refrigerant pipeline having a first port of the distributor, a plurality of liquid refrigerant branch pipelines branched from the liquid refrigerant pipeline and connected to the indoor unit expansion devices in the indoor units respectively, a gas refrigerant pipeline having a second port of the distributor, a plurality of first gas refrigerant branch pipelines branched from the gas refrigerant pipeline and connected to the indoor heat exchangers of the indoor units respectively, a plurality of second gas refrigerant branch pipelines branched from the first gas refrigerant branch pipelines respectively, and a return pipeline having all the second gas refrigerant pipelines connected thereto, and a third port of the distributor. The valve bank includes a plurality of open/close valves mounted on the first and second gas refrigerant branch pipelines.

The distributor further includes means for preventing liquefaction of the refrigerant discharged from the compressor and filled in the third pipeline fully. The means for preventing liquefaction includes a bypass pipe connected between the return pipeline and the gas refrigerant pipeline, and a distributor expansion device on the bypass pipe.

In another aspect of the present invention, there is provided a multi-type air conditioner including an outdoor unit having a compressor and an outdoor heat exchanger, a plurality of indoor units each connected to the outdoor unit and having an indoor expansion device and an indoor heat exchanger, noise preventing means on pipelines connected to respective indoor units for cutting off refrigerant flow into inoperative indoor units to prevent occurrence of refrigerant flow noise at the inoperative indoor units, and bypass means on pipelines respectively connected to the indoor units for the refrigerant caused to stay by the noise preventing means to bypass the inoperative indoor unit.

The noise preventing means may include a first valve on a pipeline connected to the indoor heat exchanger, for cutting off refrigerant flow to an inoperative indoor unit, and a second valve on a pipeline connected to the indoor expansion device, for cutting off refrigerant flow to the inoperative indoor unit. The noise preventing means may also include a first valve on a pipeline connected to the indoor heat exchanger, for cutting off refrigerant flow to an inoperative indoor unit, and an indoor expansion device having a closable system for cutting off refrigerant flow to the inoperative indoor unit.

The bypass means includes a bypass pipe connecting two pipelines connected to make the refrigerant to flow in/out of each of the indoor units, and a bypass valve on the bypass pipe for opening/closing the bypass pipe. The bypass valve has a sectional flow passage area smaller than the flow sectional area of the bypass pipe, for bypassing minimum refrigerant.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings;

FIG. 2A illustrates a system showing operation of the system in. FIG. 1 in cooling all rooms;

DETAILED DESCRIPTION OF THE PREFERRED EMBODIMENT

Reference will now be made in detail to the preferred embodiments of the present invention, examples of which are illustrated in the accompanying drawings. In describing the embodiments of the present invention, same parts will be given the same names and reference symbols, and repetitive description of which will be omitted.

Figure 1:
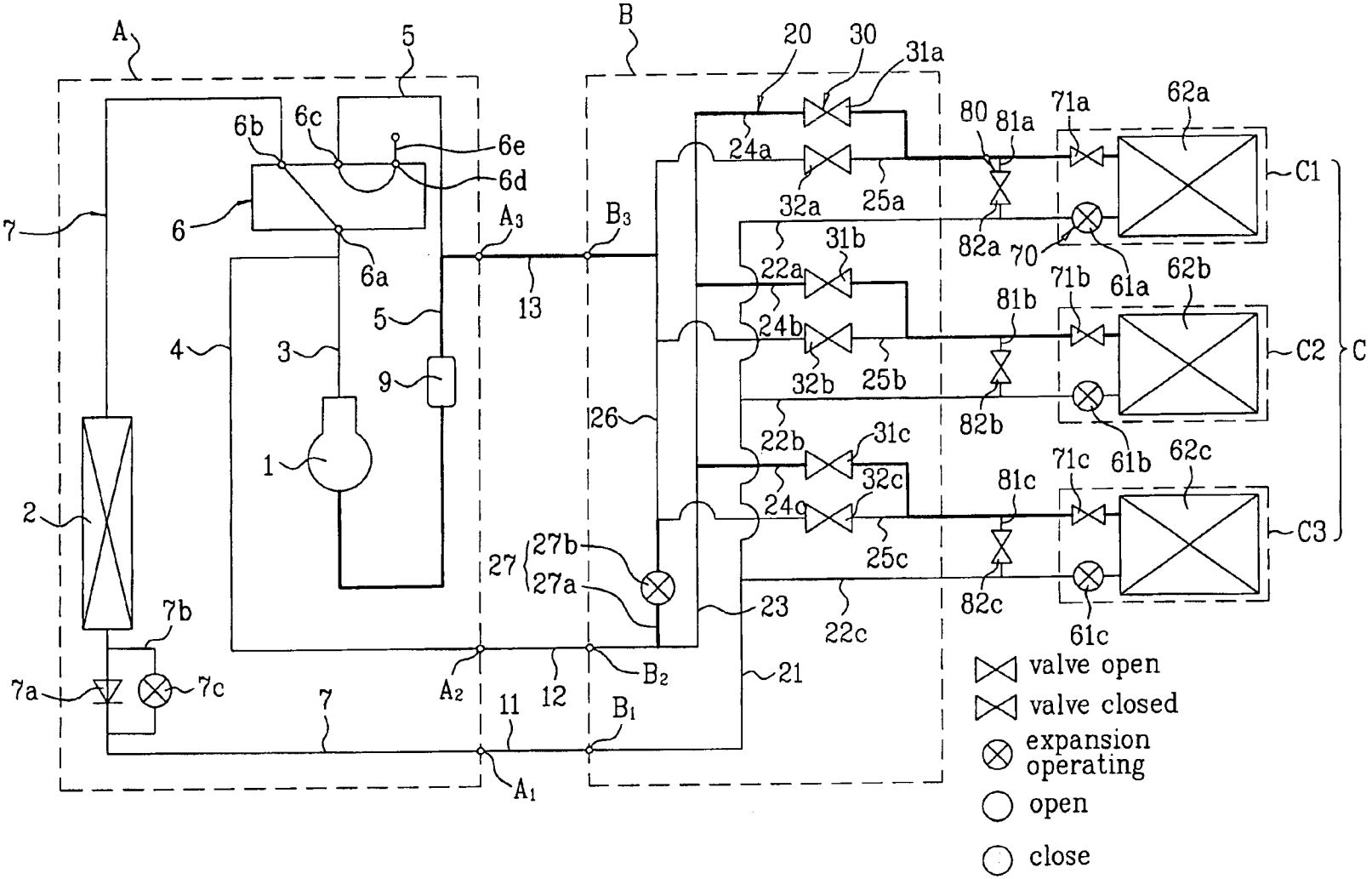
FIG. 1 illustrates a system of a multi-type air conditioner in accordance with a preferred embodiment of the present invention.

Referring to FIG. 1, the air conditioner includes an outdoor unit 'A', a distributor 'B', and a plurality of indoor units 'C'; 'C1', 'C2', and 'C3'. The outdoor unit 'A' has a compressor 1, an outdoor heat exchanger 2, a flow path control valve 6, and an outdoor unit piping system, and the distributor 'B' has a distribution piping system 20, and a valve bank 30. Each of the indoor units 'C'; has an indoor heat exchanger 62 and indoor unit expansion device 61.

The air conditioner has a system in which rooms the indoor units 'C'; 'C1', 'C2', and 'C3' are installed therein respectively are cooled or heated individually according to different operation modes of a first operation mode of cooling all rooms, a second operation mode of heating all rooms, a third operation mode of cooling a major number of the rooms and heating a minor number of rooms, and a fourth operation mode of heating a major number of the rooms and cooling a minor number of rooms. In this instance, when the multi-type air conditioner is operated in one of the operation modes, one or more of the indoor unit may not be operated. Detail of one preferred embodiment will be described with reference to FIG. 1.

For convenience of description, the following drawing reference symbols, 22 represents 22*a*, 22*b*, and 22*c*, 24 represents 24*a*, 24*b*, and 24*c*, 25 represents 25*a*, 25*b*, and 25*c*, 31 represents 31*a*, 31*b*, and 31*c*, 32 represents 32*a*, 32*b*, and 32*c*, 61 represents 61*a*, 61*b*, and 61*c*, 62 represents 62*a*, 62*b*, and 62*c*, 71 represents 71*a*, 71*b*, and 71*c*, 81 represents 81*a*, 81*b*, and 81*c*, and C represents C1, C2, and C3. Of course, a number of the indoor units 'C' and numbers of elements related thereto are varied with a number of rooms, and for convenience of description, the specification describes assuming a case when there are three rooms, i.e., a number of the indoor units are three.

The outdoor unit 'A' of the air conditioner of the present invention will be described. Referring to FIG. 1, there is a first pipeline 3 connected to an outlet of the compressor 1. The first pipeline 3 is connected to the flow path control valve 4, which controls a flow path of gas refrigerant from the compressor 1 according to respective operation modes. The flow path control valve has four ports, of which first port 6*a* is connected to the first pipeline 3.

The second port 6*b* of the flow path control valve 4 is connected to a second pipeline 7. The second pipeline 7 has one end connected to the second port 6*b* of the flow path control valve 6, and the other end connected to a first port A1 of the outdoor unit 'A' as shown in FIG. 1. As shown in FIG. 1, there is the outdoor heat exchanger 2 in the middle of the second pipeline 7.

The third port 6*c* of the flow path control valve 6 is connected to a fourth pipeline 5. The fourth pipeline 5 has one end connected to the third port 6*c*, and the other end connected to an inlet of the compressor 1. An intermediate point of the fourth pipeline 5 is in communication with the third port A3 of the outdoor unit 'A'. In the meantime, an intermediate point of the fourth pipeline 5, in more detail, at a point between the inlet of the compressor 1 and the third port A3 of the outdoor unit 'A', there is an accumulator 9.

As shown in FIG. 1, the fourth port 6*d* of the flow path control valve 6 is connected to a pipe piece 6*e* with one blanked end. Or, the fourth port 6*d* may not be connected to the pipe piece, but the fourth port 6*d* itself may be closed.

The flow path control valve 6 makes the first port 6*a* and the second port 6*b* in communication and, at the same time with this, makes the third port 6*c* and the fourth port 6*d* in communication when the multi-type air conditioner is in operation in the first or third operation mode. Also, the flow path control valve 6 makes the first port 6*a* and the fourth port 6*d* in communication and, at the same time with this, makes the second port 6*b* and the third port 6*c* in communication when the multi-type air conditioner is in operation in the second or fourth operation mode. The refrigerant flow controlled thus by the flow path control valve 6 will be described in detail, later.

In the meantime, there is a third pipeline 4, one end of which is connected to the middle of the first pipeline 3. The other end of the third pipeline 4 is connected to a second port A2 of the outdoor unit 'A'. There is a check valve 7*a* on an intermediate point of the second pipeline 7, in more detail, a point between the outdoor heat exchanger 2 and the first port A1 of the outdoor unit 'A'. It is preferable that the check valve 7*a* is mounted adjacent to the outdoor heat exchanger 2. There is an outdoor unit expansion device 7*c* on the second pipeline 7 in parallel to the check valve 7*a*. For this, a parallel pipe piece 7*b* having two ends connected to an inlet and an outlet of the check valve 7*a* is provided, and the outdoor expansion device 7*c* is mounted on the parallel pipe piece 7*b*.

The check valve 7*a* passes refrigerant flowing from the outdoor heat exchanger 2 to the first port A1 of the outdoor unit 'A', and blocks refrigerant flowing from the first port A1 of the outdoor unit 'A' to the outdoor heat exchanger 2. Therefore, the refrigerant flowing from the first port A1 of the outdoor unit 'A' to the outdoor heat exchanger 2 bypasses the check valve 7*a* to pass through the parallel pipe 7*b* and the outdoor unit expansion device 7*c*, and therefrom flows into the outdoor heat exchanger 2.

The outdoor unit 'A' having the foregoing system is connected to the distributor 'B' with a plurality of connection pipelines. For this, of the connection pipelines, a first connection pipeline 11 connects the first port A1 of the outdoor unit 'A' to the first port B1 of the distributor 'B', and a second connection pipeline 12 connects a second port A2 of the outdoor unit 'A' and a second port B2 of the distributor 'B', and a third connection pipeline 13 connects a third port A3 of the outdoor unit 'A' and a third port B3 of the distributor 'B'. Accordingly, in the multi-type air conditioner of the present invention, the outdoor unit 'A' and the distributor 'B' are connected with three pipelines.

In the meantime, it is required that the distributor 'B' guides the refrigerant from the outdoor unit 'A' to selected indoor unit 'C' exactly. Moreover, it is required that the plurality of pipelines connecting the distributor 'B' to the plurality of indoor unit 'C' are simplified, for easy piping work and improving an outer appearance. As shown in FIG. 1, the distributor 'B' of the air conditioner of the present invention designed taken the foregoing matters into account includes the distributor piping system 20, and the valve bank 30.

The distributor piping system 20 guides refrigerant flow from the outdoor unit 'A' to the indoor units 'C', and vice versa. The distributor piping system 20 includes a liquid refrigerant pipeline 21, a plurality of liquid refrigerant branch pipelines 22, a gas refrigerant pipeline 23, and a plurality of first refrigerant branch pipelines 24, a plurality of second branch pipelines 25, and a return pipeline 26.

Referring to FIG. 1, the liquid refrigerant pipeline 21 provides a first port B1 of the distributor 'B' for connection to the first connection pipeline 11. The plurality of liquid refrigerant branch pipelines 22 are branched from the liquid refrigerant pipeline 21 and connected to the indoor unit expansion devices 61 in the indoor units 'C', respectively. The gas refrigerant pipeline 23 provides a second port B2 of the distributor 'B' for connection to the second connection pipeline 12. The plurality of first gas refrigerant branch pipelines 24 are branched from the gas refrigerant pipeline 23 and connected to the indoor heat exchangers 62 of the indoor units C, respectively. The plurality of second gas refrigerant branch pipelines 25 are branched from intermediate points of the first gas refrigerant branch pipelines 24 respectively. As shown in FIG. 1, the return pipeline 26 has all the second gas refrigerant pipelines 25 connected thereto. The return pipe 26 has a third port B3 of the distributor 'B'.

The valve bank 30 in the distributor 'B' controls refrigerant flow in the distributor piping system, such that gas or liquid refrigerant is introduced into the indoor units in the rooms selectively, and returns from the indoor units 'C' to the outdoor unit 'A'. As shown in FIG. 1, the valve bank 30 includes a plurality of open/close valves 31*a*, 31*b*, 31*c*, 32*a*, 32*b*, and 32*c* mounted on the first gas refrigerant branch pipelines 24 and the second gas refrigerant branch pipelines 25, respectively. The valves 31 and 32 open or close the first gas refrigerant branch pipelines 24 and the second gas refrigerant branch pipelines 25 respectively for controlling refrigerant flow paths according to the operation modes. In the meantime, detailed control of the valve bank 30 will be described in a description of operation of the air conditioner of the present invention for each operation mode.

The distributor 'B' of the multi-type air conditioner of the present invention may also include means 27 for preventing high pressure refrigerant staying in the second connection pipeline 12 from being liquefied when the multi-type air conditioner is in the first operation mode. Because there may be shortage of refrigerant for cooling or heating if the high pressure refrigerant is stagnant and liquefied in the second connection pipeline 12, the means 27 is provided to the distributor 'B' for vaporizing liquid refrigerant and preventing liquefaction of the high pressure refrigerant in the second connection pipeline 12 to prevent shortage of refrigerant in the air conditioner at the end. The means 27 includes a bypass pipe 27*a* connected between the return pipeline 26 and the gas refrigerant pipeline 23, and a distributor expansion device 27 on the bypass pipeline 27*a*. The operation of the means 27 will be described in detail, later.

In the meantime, the indoor unit 'C', installed in each room, includes the indoor heat exchanger 62, indoor unit expansion device 61, and room fan (not shown). The indoor heat exchanger 62 is connected to respective first gas refrigerant branch pipeline 24 in the distributor 'B', and the indoor unit expansion device 61 is connected to respective liquid refrigerant branch pipeline 22 in the distributor 'B'. The indoor heat exchangers 62 and the indoor unit expansion devices 61 are connected with refrigerant pipe. The room fan blows air to respective indoor heat exchanger 62.

Noise preventing means and bypass means provided to the multi-type air conditioner of the present invention will be described. Before starting description of the noise preventing means and bypass means, necessity of the noise preventing means and bypass means will be described, briefly.

When the air conditioner of the present invention is operated, even though all of the indoor units in respective rooms may be operated, in a state particular one, or more indoor units are not in operation, the other indoor units may be in operation. That is, in a case of a large building, there are rooms of different conditions, such as rooms that require cooling, rooms that require heating, and rooms neither cooling, nor heating is required, depending on positions, and the duration of sunshine of the room in the building, and service of the room. When the air conditioner of the present invention is put into operation, the indoor unit installed in the room that requires cooling cools the room, and the indoor unit installed in the room that requires heating heats the room. Moreover, the indoor unit in the room that requires no cooling or heating is not operated.

During the air conditioner is operated thus, since a small amount of refrigerant is introduced into the indoor unit that is not operated, refrigerant flow noise is occurred at the inoperative indoor unit. When the flow noise is occurred at the inoperative indoor unit, not only persons in the room feels not comfortable, but also the user, mistaking that the indoor unit is out of order, can try to repair, that deteriorates reliability of an air conditioning system. Therefore, an improvement is required for resolving the problem.

Referring to FIG. 1, for this, the multi-type air conditioner of the present invention provides noise preventing means 70 for preventing occurrence of refrigerant flow noise from an inoperative indoor unit. The noise preventing means 70 includes valves on one or all of the pipelines connected to the indoor units, i.e., the liquid refrigerant branch pipeline 22 and the first gas refrigerant branch pipeline 24 for cutting off flow of the refrigerant into the inoperative indoor units. Hereafter, the valve on the first gas refrigerant branch pipeline 24 is called as a first valve 71, and the valve on the liquid refrigerant branch pipeline 22 is called as a second valve.

The noise preventing means 70 may include only one of the first valve 71 and the second valve. However, of enhancing a system reliability, it is preferable that the noise preventing means 70 includes both the first valve 71 and the second valve. An embodiment including the noise preventing means 70 including the first valve 71 and the second valve as shown in FIG. 1 will be described.

Referring to FIG. 1, the first valve 71 is mounted on the first gas refrigerant branch pipeline 24. The first valve 71 may be, for an example, an open/close valve. If the open/close valve is employed as the first valve 71, an equipment cost can be saved. The first valve 71 opens/closes a flow passage of the first gas refrigerant branch pipeline 24. Therefore, if the first valve 71 is closed, the refrigerant introduced into the first gas refrigerant branch pipeline 24 is not introduced into the indoor unit 'C'. Of course, the refrigerant can not flow from the liquid refrigerant branch pipeline 22 to the first gas refrigerant branch pipeline 24 through the indoor unit 'C', too. According to this, the prevention of refrigerant flow to the indoor unit 'C' can prevent occurrence of the refrigerant flow noise.

The second valve is mounted on the liquid refrigerant branch pipeline 22. alike the first valve 71, the second valve may be an open/close valve provided separately. In this case, in the same principle as the first valve 71, the second valve prevents the refrigerant from flowing through the indoor unit 'C', thereby preventing occurrence of the noise. However, the second valve may not be provided separately. In this case, as shown in FIG. 1, the indoor expansion device 61 in the indoor unit 'C' carries out a function of the second valve. For this, it is required that the indoor expansion device 61 has a system in which a flow passage of the liquid refrigerant branch pipeline 22 can be opened/closed, without fail. If the indoor expansion device 61 has such a system, since the flow passage of the liquid refrigerant branch pipeline for the inoperative indoor unit can be closed, a function the same with the first valve 71 can be carried out.

In the meantime, if the noise preventing means 70 can cut off the refrigerant flow to the inoperative indoor unit, there may be refrigerant staying in the first gas refrigerant branch pipeline 24 or the liquid refrigerant branch pipeline 22 failed to enter into the inoperative indoor unit. Such a stay of refrigerant is liable to condense, to cause shortage of refrigerant in the air conditioner. Therefore, an improved structure for preventing the stay of the refrigerant, flow of which is cut off by the noise preventing means 70, is required.

For meeting the requirement, bypass means 80 may be provided to the air conditioner of the present invention, additionally. As shown in FIG. 1, the bypass means 80 is mounted on the first gas refrigerant branch pipeline 24 and the liquid refrigerant branch pipeline 22, for making the refrigerant stayed by the noise preventing means to bypass the indoor unit.

The bypass means 80 includes a bypass pipe 81 and a bypass valve 82. The bypass pipe 81 has one end in communication with the first gas refrigerant branch pipeline 24 and the other end in communication with the liquid refrigerant branch pipeline 22. As shown in FIG. 1, the bypass valve 82 is mounted on the bypass pipe 81 for opening/closing the bypass pipe 81. It is preferable that the bypass valve 82 is an open/close valve having a simple structure and low cost. The bypass valve 82 is opened when the noise preventing means 70 cut off the refrigerant flow, and closed when the noise preventing means 70 permits the refrigerant flow.

If the bypass means 80 is provided thus, the stay of refrigerant, flow of which is cut off by the noise preventing means 70 during operation of the air conditioner, can be prevented, effectively. The reason is as follows. In a case the refrigerant flows toward an indoor unit 'C' side through the first gas refrigerant branch pipeline 24, the refrigerant cut off by the second valve or the indoor expansion device 61 is transferred to the first gas refrigerant branch pipeline 24 via the bypass pipe 81 and the bypass valve 82. According to this, the refrigerant is, not staying, but keep flowing, to solve the foregoing problem. In the meantime, it is preferable that the bypass valve 82 has a sectional flow passage area smaller than the flow sectional area of the bypass pipe 81, for bypassing minimum refrigerant.

In the multi-type air conditioner of the present invention, so as to be proper to respective operation modes, a flow path and a flow direction of the gas refrigerant from the compressor 1 are changed under the control of the flow path control valve 6 in the outdoor unit 'A', and a flow path and a flow direction of the gas refrigerant are changed under the control of the valve bank 30 both in the distributor 'B' and the indoor unit 'C', in individual heating or cooling of the rooms. Refrigerant flow under the control of the flow path control valve 6 and the valve bank 30 in the individual cooling or heating of the rooms will be described for each of the operation modes, hereafter. For convenience of description, it is assumed that two indoor units C1 and C2 cool the rooms, and the other one indoor unit C3 heat the room in the third operation mode. It is also assumed that two indoor units C1 and C2 heat the rooms and the other one indoor unit C3 cools the room in the fourth operation mode.

Figure 2A:
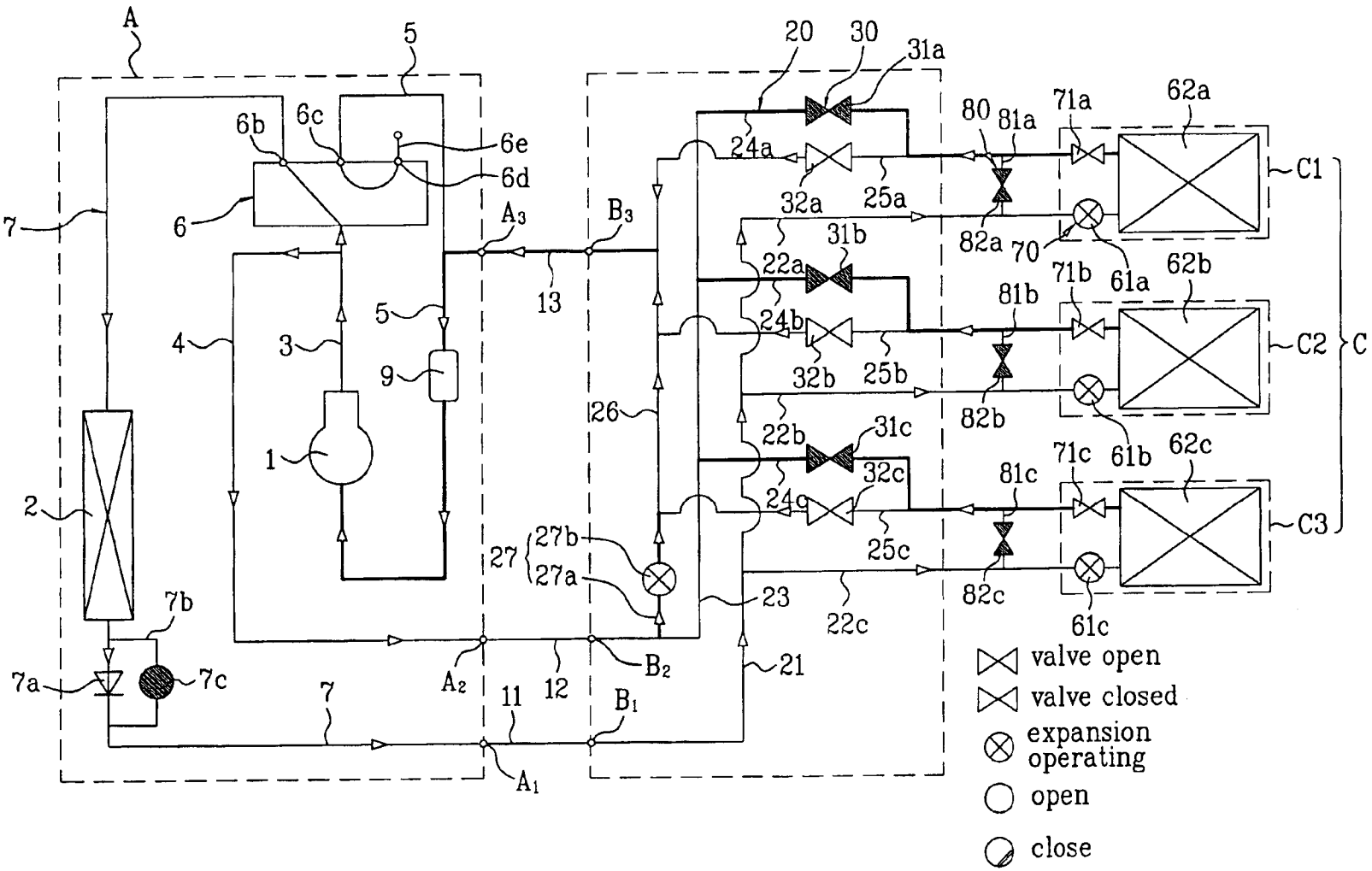

FIG. 2A illustrates a system showing operation of the system in FIG. 1 in cooling all rooms. In the first operation mode when all the indoor units cool the rooms, the flow path control valve 6 makes the first port 6*a* and the second port 6*b* in communication, and at the same time makes the third port 6*c* and the fourth port 6*d* in communication. Accordingly, most of the refrigerant from the outlet of the compressor 1 is introduced into the second pipeline 7 via the first pipeline 3. As shown in FIG. 2A, a portion of the refrigerant from the compressor 1 is introduced into the third pipeline 4 connected to the first pipeline 3. A refrigerant flow introduced into the second pipeline 7 from the compressor 1 will be described.

The refrigerant introduced into the second pipeline 7 heat exchanges with the external air, and condensed at the outdoor heat exchanger 2. The condensed liquid refrigerant is introduced into the liquid refrigerant pipeline 21 in the distributor 'B', via the check valve 7*a*, the first port A1 of the outdoor unit 'A', and the first connection pipeline 11. The refrigerant introduced into the liquid refrigerant pipeline 21 in the distributor 'B' is introduced into the indoor unit expansion devices 61 through the liquid refrigerant branch pipelines 22, respectively. The refrigerant expanded at the indoor unit expansion devices 61 heat exchanges at the indoor heat exchangers 62 to cool the rooms, respectively. As shown in FIG. 2A, in the first operation mode, since all bypass valves 82 are closed, there is no influence to the refrigerant flow in the first gas refrigerant branch pipeline 24 and the liquid refrigerant branch pipeline 22.

In the first operation mode, the valve bank 30 in the distributor 'B' is controlled such that the valves 31*a*, 31*b* and 31*c* on the first gas refrigerant pipelines 24*a*, 24*b* and 24*c* are closed, and the valves 32*a*, 32*b*, and 32*c* on the second gas refrigerant pipelines 25*a*, 25*b*, and 25*c* are opened. Therefore, as shown in FIG. 2A, the gas refrigerant vaporized at the indoor heat exchangers 62 while cooling down the room air is introduced into the return pipeline 26 through the second gas refrigerant branch pipelines 25.

In the meantime, the refrigerant, discharged from the compressor 1 to the third pipeline 4, is introduced into the gas refrigerant pipeline 23 via the second port A2 of the outdoor unit 'A', the second connection pipeline 12, and the second port B2 of the distributor 'B'. In the meantime, as shown in FIG. 2A, since the valves 31*a*, 31*b*, and 31*c* mounted on the first gas refrigerant branch pipelines 24 connected to the gas refrigerant pipeline 23 are closed, the gas refrigerant introduced into the gas refrigerant pipeline 23 is guided to the bypass pipeline 27*a*, and, therefrom, flows to the return pipeline 26 after expanded at the distributor expansion device 27*b*. Accordingly, the means 27 prevents liquefaction of the gas refrigerant filled fully in the third pipeline 4 and the second connection pipeline 12 in a stagnant state, effectively.

The gas refrigerant joined at the return pipeline 26 is introduced into the fourth pipeline 5 via the third port B3 of the distributor 'B', the third connection pipeline 13, and the third port A3 of the outdoor unit 'A'. In the meantime, the third port 6*c* of the flow path control valve 6 one end of the fourth pipeline 5 is connected thereto is in communication with the fourth port 6*d* connected to the blanked pipe piece 6*e* in the first operation mode. Therefore, the refrigerant is introduced from the fourth pipeline 5 to the inlet of the compressor 1 via the accumulator 9.

Figure 2B:
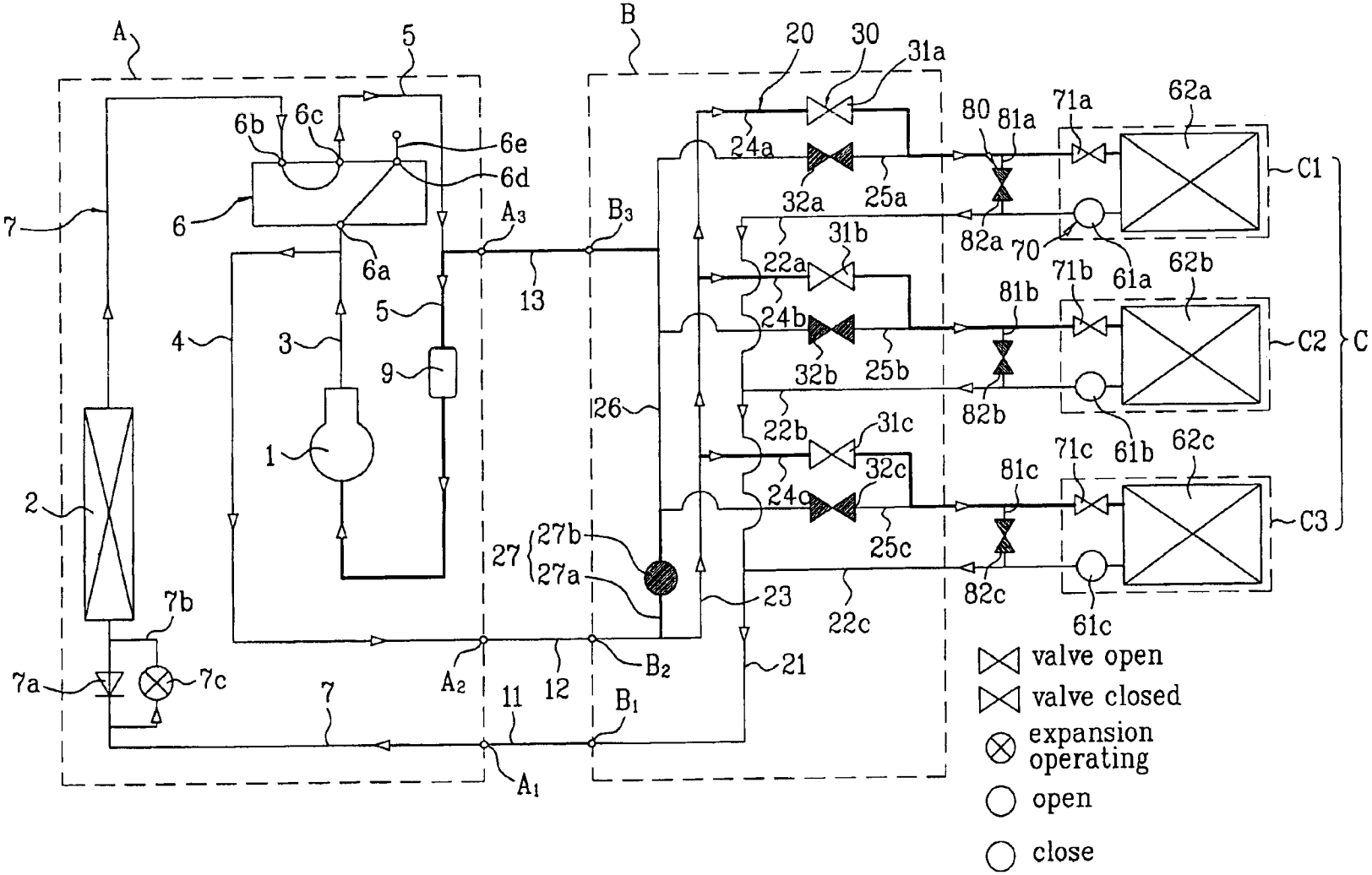
FIG. 2B illustrates a system showing operation of the system in FIG. 1 in heating all rooms.

FIG. 2B illustrates a system showing operation of the system in FIG. 1 in the second operation mode. In the second operation mode, when all rooms are heated, the flow path control valve 6 makes the first port 6*a* and the fourth port 6*d* in communication, and at the same time makes the second port 6*b* and the third port 6*c* in communication. According to this, as shown in FIG. 2B, entire refrigerant is introduced from the compressor 1 to the third pipeline 4 via the first pipeline 3. The gas refrigerant is introduced from the third pipeline 4 into the gas refrigerant pipeline 23 via the second port A2 of the outdoor unit 'A', the second connection pipeline 12, and the second port of the distributor 'B'.

In the second operation mode, the distributor expansion device 27*b* is closed, the valves 31 a, 31*b*, and 31*c* on the first gas refrigerant branch pipelines 24 are opened, and the valve 32*a*, 32*b*, and 32*c* on the second gas refrigerant branch pipelines 25 are closed. Therefore, entire refrigerant introduced into the gas refrigerant pipeline 23 is introduced into the first gas refrigerant branch pipelines 24, and heat exchanges with room air, and is condensed at the indoor heat exchangers 62. In this instance, the indoor heat exchanger 62 discharges condensing heat, and the room fan (not shown) discharges the condensing heat into the room, to heat the room. As shown in FIG. 2B, since the indoor unit expansion device 61 is opened in the second operation mode, the refrigerant condensed at the indoor heat exchanger 62 is introduced into the liquid refrigerant pipeline 21 through the liquid refrigerant branch pipelines 22. As shown in FIG. 2B, since all the bypass valves 82 are closed in the second operation mode, the refrigerant flow in the first gas refrigerant branch pipeline 24 and the liquid refrigerant branch pipeline 22 is not influenced.

The refrigerant introduced into the liquid refrigerant pipeline 21 is introduced into the second pipeline 7 via the first port B1 of the distributor 'B', the first connection pipeline 11, and the first port A1 of the outdoor unit 'A'. The refrigerant is introduced from the second pipeline 7 to the parallel pipe piece 7*b* under the guidance of the check valve 7*a*, and expanded at the outdoor expansion device 7*c*. The refrigerant expanded at the outdoor expansion device 7*c* heat exchanges, and is vaporized at the outdoor heat exchanger 2. Then, the vaporized refrigerant is introduced into the fourth pipeline 5 guided by the flow path control valve 6, and enters into the inlet of the compressor 1 via the accumulator 9. In this instance, since the valves 32*a*, 32*b*, and 32*c* mounted on the second gas refrigerant branch pipelines 25 are closed, the refrigerant is only introduced from the fourth pipeline 5 to the compressor 1. Of course, a portion of the refrigerant may be introduced up to the return pipeline 26 through the third connection pipeline 13, the amount is minimal.

Figure 3A:
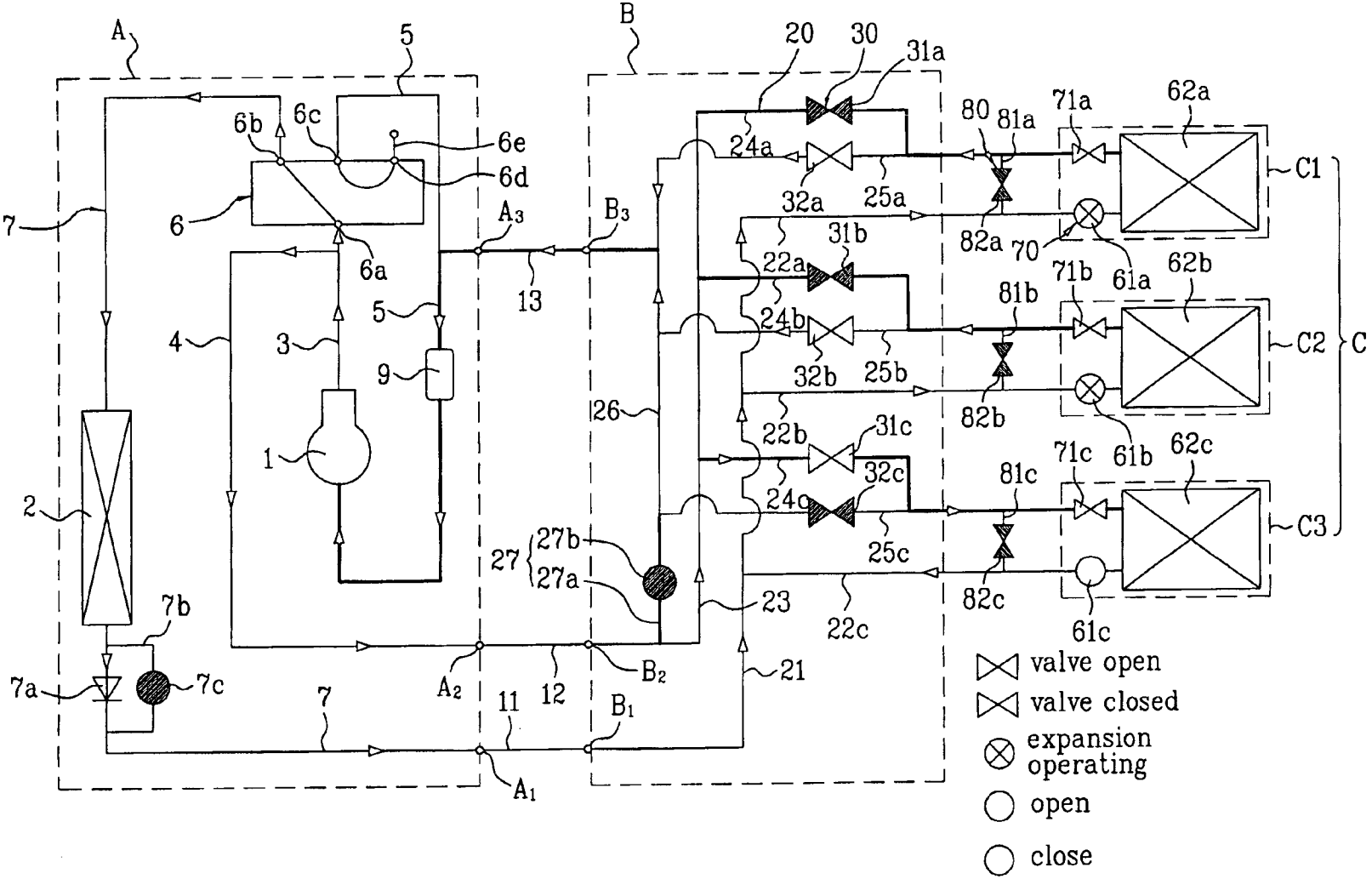
FIG. 3A illustrates a system showing operation of the system in FIG. 1 in cooling a major number of rooms and heating a minor number of rooms.

FIG. 3A illustrates a system showing operation of the system in FIG. 1 in the third operation mode. Identical to the first operation mode, in the third operation mode, when a major number of rooms are cooled, and a minor number of rooms are heated, the flow path control valve makes the first port 6*a* and the second port 6*b* in communication, and the third port 6*c* and the fourth port 6*d* in communication. Therefore, a portion of the refrigerant is introduced from the compressor 1 into he second pipeline 7, and the other portion is introduced into the third pipeline 4. Description of the process, identical to the refrigerant flow in the first operation mode described with reference to FIG. 2A, will be omitted.

In the third operation mode, the distributor expansion device 27*b* is closed. The valves 31*a* and 31*b*, mounted on the first gas refrigerant branch pipelines 24*a* and 24*b* connected to the indoor units C1 and C2 which cool the rooms, are closed, and the valves 32*a* and 32*b* mounted on the second gas refrigerant branch pipelines 25*a* and 25*b* are opened. The valve 31*c* on the first gas refrigerant branch pipeline 24*c* connected to the indoor unit C3 which heats the room is opened, and the valve 32*c* on the second gas refrigerant branch pipeline 25*c* is closed. Therefore, as shown in FIG. 3A, the refrigerant, passed through the third pipeline 4 and introduced into he gas refrigerant pipeline 23 of the distributor 'B', is introduced into the indoor heat exchanger 62*c* in the indoor unit C3 via the first gas refrigerant branch pipeline 24*c*, discharges condensing heat at the indoor heat exchanger 62*c* to heat the room, and introduced into the liquid refrigerant pipeline 21 via the indoor unit expansion device 61*c* in a liquid state. As shown in FIG. 3A, in the third operation mode, since all bypass valve 82 is closed, the refrigerant flow in the first gas refrigerant branch pipeline 24 and the liquid refrigerant branch pipeline 22 is not influenced.

Referring to FIG. 3A, the refrigerant, discharged from the compressor 1 to the liquid refrigerant pipeline 21 in the distributor 'B' via the second pipeline 7, joins with the refrigerant introduced into the liquid refrigerant pipeline 21 after heating the room at the indoor unit C3. Then, the joined refrigerant is introduced into the indoor unit expansion devices 61*a* and 61*b* of the indoor units C1 and C2 through the liquid refrigerant branch pipelines 22*a* and 22*b*, vaporized at the indoor heat exchangers 62*a* and 62*b*, to cool the rooms, and introduced into the return pipeline 26 via the second gas refrigerant branch pipelines 25*a* and 25*b*. The refrigerant is introduced from the return pipeline 26 to the fourth pipeline 5 through the third connection pipeline 13, and, therefrom, to the inlet of the compressor 1 via the accumulator 9.

Figure 3B:
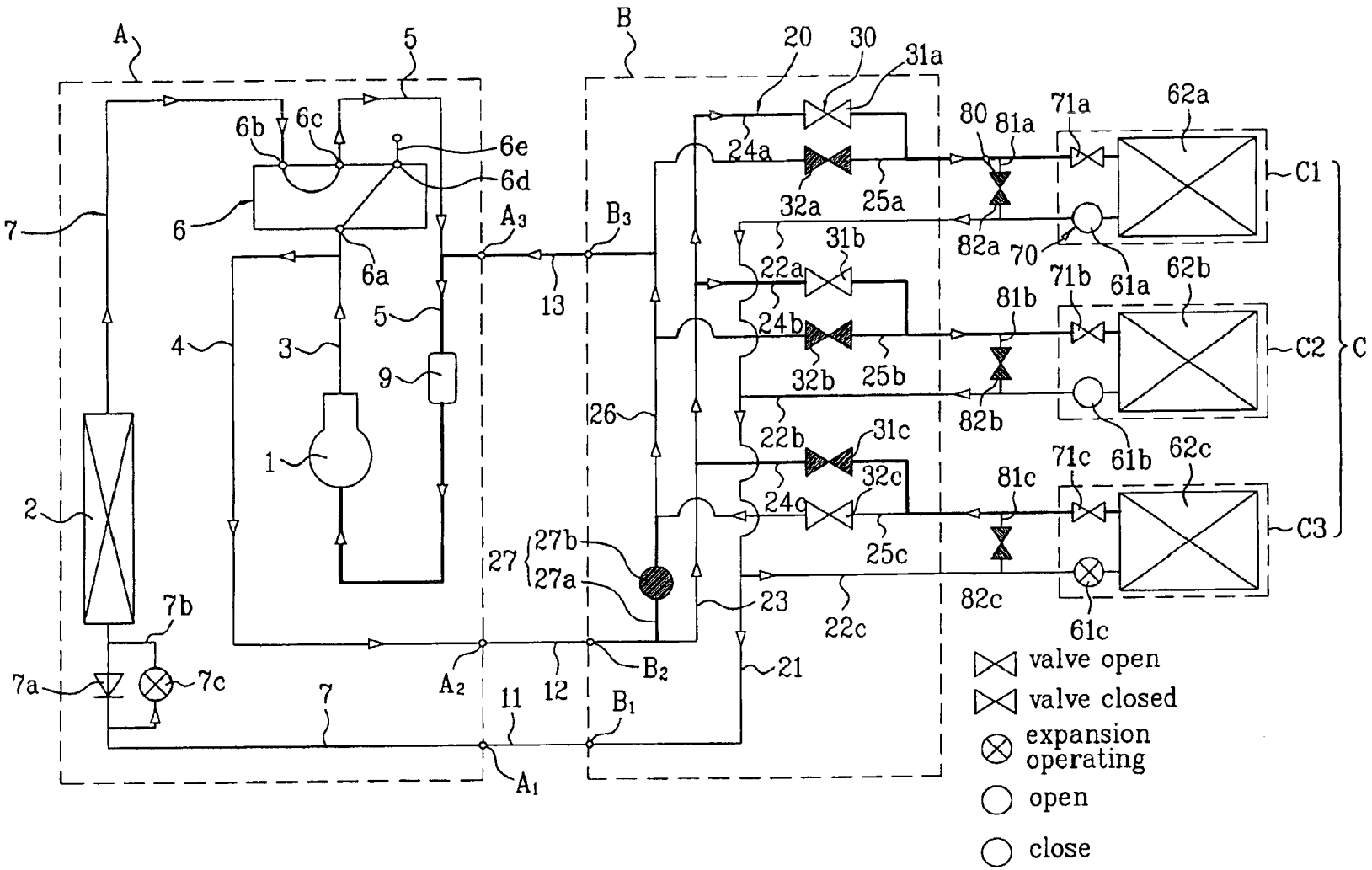
FIG. 3B illustrates a system showing operation of the system in FIG. 1 in heating a major number of rooms and cooing a minor number of rooms.

FIG. 3B illustrates a system showing operation of the system in FIG. 1 in the fourth operation mode. In the fourth operation mode, when a major number of rooms are heated and a minor number of rooms are cooled, the flow path control valve 6 makes the first port 6*a* and the fourth port 6*d* in communication and makes the second port 6*b* and the third port 6*d* in communication. Therefore, entire refrigerant is introduced from the compressor 1 to the distributor 'B' via the third pipeline 4.

In the fourth operation mode, the distributor expansion device 27*b* is closed. The valves 31*a*, and 31*b* on the first gas refrigerant branch pipelines 24*a* and 24*b* connected to the indoor units C1 and C2 which heat the rooms are opened, and the valves 32*a* and 32*b* on the second gas refrigerant branch pipelines are closed. The valve 31*c* on the first gas refrigerant branch pipeline 24*c* connected to the indoor unit C3 which cools the room is closed, and the valve 32*c* on the second gas refrigerant branch pipeline 25*c* is opened. Therefore, the refrigerant introduced into the gas refrigerant pipeline 23 of the distributor 'B' via the second pipeline 7 is introduced into the indoor heat exchangers 62*a* and 62*b* via the first gas refrigerant branch pipelines 24*a* and 24*b*, and flows to the liquid refrigerant pipeline 21 via the liquid refrigerant branch pipelines 22*a* and 22*b* after heating the rooms at the indoor units C1 and C2.

Referring to FIG. 3B, a portion of the refrigerant introduced into the liquid refrigerant pipeline 21 is introduced into the liquid refrigerant branch pipelines 22*c* and the other portion of the refrigerant flows toward the first connection pipeline 11. In this instance, the refrigerant introduced into the first connection pipeline 11 is introduced into the fourth pipeline 5 via the second pipeline 7, the parallel pipe piece 7*b*, the outdoor unit expansion device 7*c*, the outdoor heat exchanger 2, and the flow path control valve 6. The refrigerant introduced into the liquid refrigerant branch pipeline 22*c* passes through the indoor expansion valve 61 and the indoor heat exchanger 62*c* of the indoor unit C3, and cools the room, and, therefrom, introduced into the fourth pipeline 5 via the second gas refrigerant branch pipeline 25*c*, the return pipeline 26, and the third connection pipeline 13. Finally, the refrigerant joined at the fourth pipeline 5 is introduced into the inlet of the compressor 1 via the accumulator 9. As shown in FIG. 3B, in the fourth operation mode operated thus, since all bypass valves 82 are closed, the refrigerant flow in the first gas refrigerant branch pipeline 24 and the liquid refrigerant branch pipeline are not influenced.

In each of the first to fourth operation modes, all the bypass valves 82 maintain a closed state. However, in a case the air conditioner is in operation in a state one or more than one indoor unit is not in operation, a bypass valve adjacent to the inoperative indoor unit is opened. A refrigerant flow in this case will be described with reference to FIG. 4. For reference, FIG. 4 illustrates an embodiment in which the multi-type air conditioner is operated in a state two indoor units C1 and C2 are operated to cool the rooms, and one indoor unit C3 is not in operation, which is identical to a state one indoor unit C3 is not operated in the first operation mode.

Figure 4:
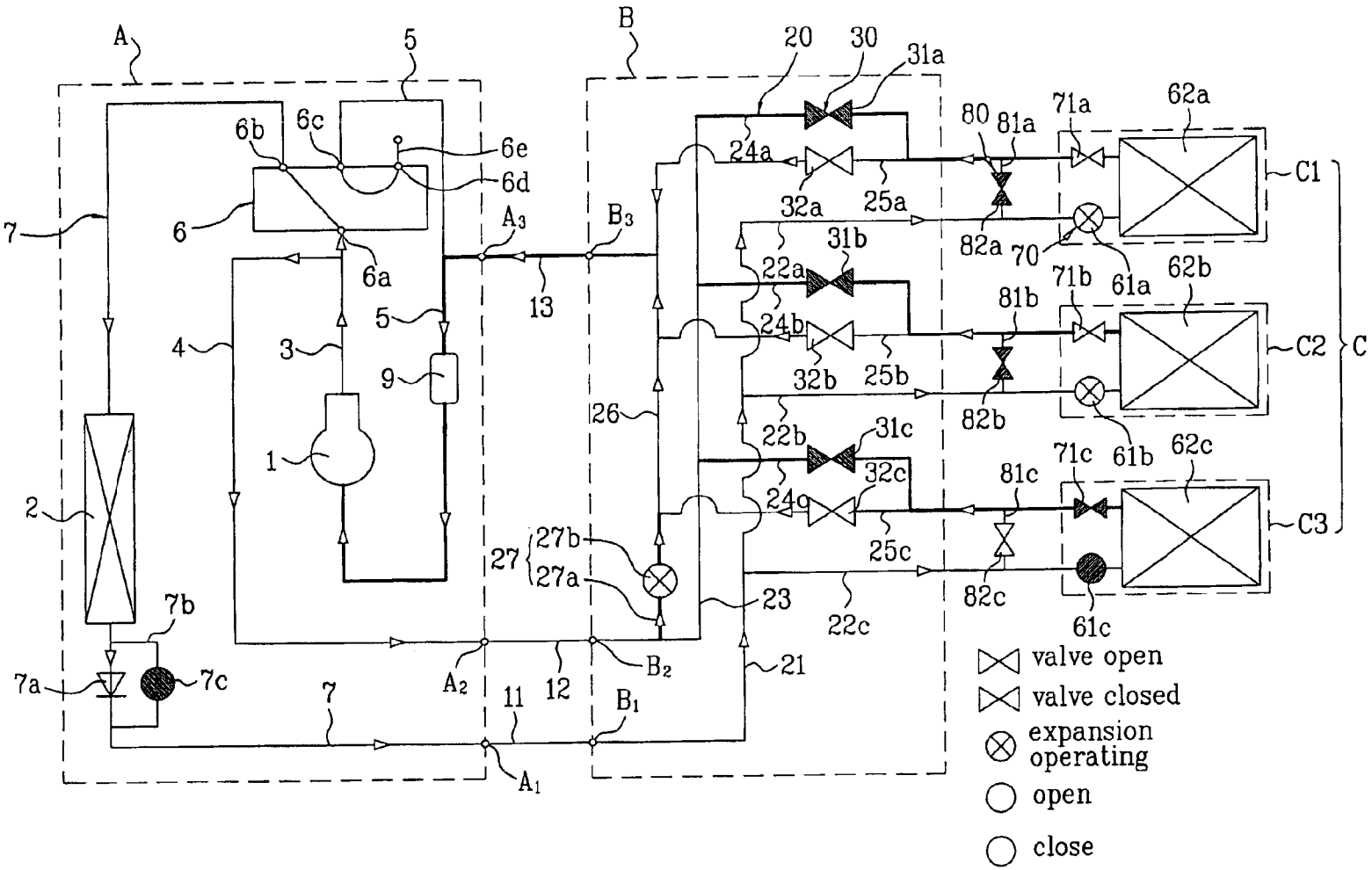
FIG. 4 illustrates a system showing operation of the system in FIG. 1 when one indoor unit is not in operation while rest of the indoor units cool respective rooms.

Referring to FIG. 4, the first valve 71*c* and the indoor expansion device 61*c* adjacent to the inoperative indoor unit C3 are closed. The bypass valve 82 adjacent to the indoor unit C3 is opened. Under the state, the refrigerant flowing toward an indoor unit C3 side via the liquid refrigerant branch pipeline 22*c* is introduced into the bypass pipeline 81*c* by the closed indoor expansion device 61*c*. The refrigerant introduced into the bypass pipe 81*c* is introduced into the first gas refrigerant branch pipeline 24*c* via the bypass valve 82*c*. In this instance, since the first valve 71*c* is in a closed state, the refrigerant flows toward a distributor 'B' side. In the meantime, though not shown, if any one of the indoor units is not in operation in the second operation mode, the refrigerant moves to an indoor unit side through the first gas refrigerant branch pipeline 24. In this case, owing to the noise preventing means 70 and the bypass means 80, the refrigerant is introduced, not into the indoor unit, but into the liquid refrigerant branch pipeline 22, and moves to the distributor 'B'. Therefore, no refrigerant is introduced into the inoperative indoor unit, and stay of the refrigerant in the refrigerant pipeline can be prevented.

As has been described, the multi-type air conditioner of the present invention has the following advantages.

First, the independent cooling or heating of the plurality of rooms can provide an optimal air condition performance proper to an environment of each room.

Second, refrigerant introduction into inoperative indoor unit when the air conditioner is operated is prevented by the noise preventing means. Therefore, the occurrence of refrigerant flow noise coming from the inoperative indoor unit can be prevented perfectly.

Third, staying of refrigerant and consequential shortage of the refrigerant can be prevented as the refrigerant in the refrigerant pipeline connected to the inoperative indoor unit is bypassed by the bypass means. Therefore, deterioration of the air conditioner performance can be prevented.

In the meantime, a multi-unit air conditioner has been described, in which one outdoor unit, one distributor, and a plurality of indoor units are provided for independent cooling or heating of rooms. It will be apparent to those skilled in the art that various modifications and variations can be made in the present invention without departing from the spirit or scope of the invention. For an example, in the case of the multi-type air conditioner having one outdoor unit and a plurality of indoor units connected to the one outdoor unit directly, all of the plurality of rooms can be heated or cooled. In this case too, the air conditioner can be operated in a state one or more than one indoor unit are not in operation according to setting by the user. Accordingly, it is apparent to persons skilled in this field of art that the noise preventing means and the bypass means also can be mounted at the same positions and can serve the same functions. Thus, it is intended that the present invention cover the modifications and variations of this invention provided they come within the scope of the appended claims and their equivalents.

What is claimed is:

1. A multi-type air conditioner comprising:

an outdoor unit including a compressor, an outdoor heat exchanger, a flow path control valve that controls a flow path of a refrigerant from the compressor, and an outdoor unit piping system;

a plurality of indoor units each having an indoor expansion device, an indoor heat exchanger, and an indoor piping system;

a distributor that selectively distributes the refrigerant from the outdoor unit to the plurality of indoor units and from the plurality of indoor units to the outdoor unit according to respective operation modes;

a noise preventor provided on respective pipelines connected to each of the indoor units and comprising a respective first valve connected to a respective open/close valve, the noise preventor being configured to cut off refrigerant flow to inoperative indoor units when the air conditioner is in operation, thereby preventing an occurrence of refrigerant flow noise at the inoperative indoor units; and a bypass for the refrigerant in the pipeline connected to the indoor expansion device to bypass the inoperative indoor unit.

2. The multi-type air conditioner as claimed in claim 1, wherein the first valve on a pipeline connected to the indoor heat exchanger is configured to cut off a supply of the refrigerant to the inoperative indoor unit.

3. The multi-type air conditioner as claimed in claim 1, wherein the noise preventor includes a second valve on a pipeline connected to the indoor expansion device configured to cut off a supply of the refrigerant to the inoperative indoor unit.

4. The multi-type air conditioner as claimed in claim 1, wherein the noise preventor includes the indoor expansion device which is configured to cut off refrigerant to the inoperative indoor unit.

5. The multi-type air conditioner as claimed in claim 2, wherein the noise preventor includes a second valve on a pipeline connected to the indoor expansion device that is configured to cut off refrigerant to the inoperative indoor unit.

6. The multi-type air conditioner as claimed in claim 2, wherein the noise preventor further comprises the indoor expansion device is configured to cut off refrigerant supply to the inoperative indoor unit.

7. The multi-type air conditioner as claimed in claim 1, wherein the bypass includes:

a bypass pipe connecting two pipelines that provide the refrigerant to flow in/out of each of the indoor units; and a bypass valve configured to open/close a passageway in the bypass pipe.

8. The multi-type air conditioner as claimed in claim 7, wherein the bypass valve has a sectional flow passage area smaller than the flow sectional area of the bypass pipe, for bypassing minimum refrigerant.

9. The multi-type air conditioner as claimed in claim 1, wherein the flow path control valve includes:

a first port in communication with an outlet of the compressor, a second port in communication with the outdoor heat exchanger, a third port in communication with an inlet of the compressor, and a fourth port blanked, or connected to a closed pipe piece.

10. The multi-type air conditioner as claimed in claim 9, wherein the outdoor piping system includes:

a first pipeline connected between the outlet of the compressor and the first port, a second pipeline connected between the second port and the first port of the outdoor unit, the second pipeline comprising the outdoor heat exchanger, a third pipeline connected between the first pipeline and the second pipeline of the outdoor unit, and a fourth pipeline connected between the third port and the inlet of the compressor, the fourth pipeline being connected to the third port of the outdoor unit.

11. The multi-type air conditioner as claimed in claim 10, wherein the outdoor unit further includes an accumulator on the fourth pipeline between the third port of the outdoor unit and the inlet of the compressor.

12. The multi-type air conditioner as claimed in claim 10, wherein the outdoor unit further includes:

a check valve provided on the second pipeline between the outdoor heat exchanger and the first port of the outdoor unit, and an outdoor expansion device provided on the second pipeline and connected in parallel to the check valve.

13. The multi-type air conditioner as claimed in claim 12, wherein the check valve permits refrigerant flow from an outdoor heat exchanger side to a first port side.

14. The multi-type air conditioner as claimed in claim 10, wherein the first port of the outdoor unit is connected to the first port of the distributor, the second port of the outdoor unit is connected to the second port of the distributor, and the third port of the outdoor unit is connected to the third port of the distributor.

15. The multi-type air conditioner as claimed in claim 14, wherein the distributor includes:

a distributor piping system that guides refrigerant from the outdoor unit to the indoor units, and from the indoor units to the outdoor unit; and a valve bank on the distributor piping system that controls the refrigerant flowing in the distributor piping system according to respective operation modes.

16. The multi-type air conditioner as claimed in claim 15, wherein the distributor piping system includes:

a liquid refrigerant pipeline comprising a first port of the distributor, a plurality of liquid refrigerant branch pipelines branched from the liquid refrigerant pipeline and connected to each of the indoor unit expansion devices in the indoor units, a gas refrigerant pipeline comprising a second port of the distributor, a plurality of first gas refrigerant branch pipelines branched from the gas refrigerant pipeline and connected to each of the indoor heat exchangers of the indoor units, a plurality of second gas refrigerant branch pipelines branched from the first gas refrigerant branch pipelines respectively, and a return pipeline connected to the second gas refrigerant pipelines and a third port of the distributor.

17. The multi-type air conditioner as claimed in claim 16, wherein the valve bank includes a plurality of open/close valves provided on the first and second gas refrigerant branch pipelines.

18. The multi-type air conditioner as claimed in claim 17, wherein the distributor further includes a liquefaction preventor that prevents liquefaction of the refrigerant discharged from the compressor and filled in the third pipeline.

19. The multi-type air conditioner as claimed in claim 18, wherein the liquefaction preventor includes:

a bypass pipe connected between the return pipeline and the gas refrigerant pipeline, and a distributor expansion device connected to the bypass pipe.

20. A multi-type air conditioner comprising:

an outdoor unit having a compressor and an outdoor heat exchanger;

a plurality of indoor units in which each indoor unit is connected to the outdoor unit and each indoor unit comprises an indoor expansion device and an indoor heat exchanger;

a noise preventor connected to respective indoor units and comprising a respective first valve connected to a respective open/close valve, the noise preventor being configured to cut off refrigerant flow to inoperative indoor units to prevent an occurrence of refrigerant flow noise at the inoperative indoor units; and a bypass connected to each of the indoor units such that the refrigerant of the noise preventor is configured to bypass the inoperative indoor unit.

21. A multi-type air conditioner as claimed in claim 20, wherein the noise preventor includes:

the first valve connected to the indoor heat exchanger, the first valve being configured to cut off refrigerant flow to an inoperative indoor unit, and a second valve on a pipeline connected to the indoor expansion device, the second valve being configured to cut off refrigerant flow to the inoperative indoor unit.

22. A multi-type air conditioner as claimed in claim 20, wherein the noise preventor includes:

the first valve on a pipeline connected to the indoor heat exchanger, the first valve being configured to cut off refrigerant flow to an inoperative indoor unit, and an indoor expansion device having a closable system configured to cut off refrigerant flow to the inoperative indoor unit.

23. A multi-type air conditioner as claimed in claim 20, wherein the bypass includes:

a bypass pipe connecting two pipelines such that the refrigerant is configured to flow in/out of each of the indoor units, and a bypass valve on the bypass pipe configured for opening/closing the bypass pipe.

24. The multi-type air conditioner as claimed in claim 23, wherein the bypass valve has a sectional flow passage area smaller than the flow sectional area of the bypass pipe, for bypassing minimum refrigerant.

* * * * *